US010293352B2

(12) United States Patent
Pastor et al.

(10) Patent No.: US 10,293,352 B2
(45) Date of Patent: May 21, 2019

(54) HAND HELD FLUID DISPENSING APPARATUS

(71) Applicant: Karcher North America, Inc., Denver, CO (US)

(72) Inventors: Marcos Moreno Pastor, San Nicolas de los Garza (MX); Jesus Rafael Flores Montano, General Escobedo (MX)

(73) Assignee: Kärcher North America, Inc., Denver, CO (US)

( * ) Notice: Subject to any disclaimer, the term of this patent is extended or adjusted under 35 U.S.C. 154(b) by 0 days.

(21) Appl. No.: 15/043,188

(22) Filed: Feb. 12, 2016

(65) Prior Publication Data

US 2016/0236216 A1 Aug. 18, 2016

Related U.S. Application Data

(60) Provisional application No. 62/115,857, filed on Feb. 13, 2015, provisional application No. 62/204,687, filed on Aug. 13, 2015.

(51) Int. Cl.
*B05B 9/01* (2006.01)
*B05B 12/00* (2018.01)

(52) U.S. Cl.
CPC ..... *B05B 9/01* (2013.01); *B05B 12/0026* (2018.08)

(58) Field of Classification Search
CPC ..... B05B 9/01; B05B 12/002; B05B 9/08; B05B 12/0022; B05B 12/0026; B08B 3/028
USPC ..... 239/526, 415; 222/174
See application file for complete search history.

(56) References Cited

U.S. PATENT DOCUMENTS 1,651,466 A * 12/1927 Norris ..... B05B 7/0433 239/415
1,797,209 A * 3/1931 Bramsen ..... B05B 7/1209 239/300
3,394,694 A 7/1968 Leclerc
4,431,118 A 2/1984 Namdari
D315,014 S 2/1991 Clivio
5,092,362 A * 3/1992 Yie ..... B05B 1/306 137/596.1
5,236,129 A 8/1993 Grime et al.
5,332,159 A 7/1994 Grime et al.
5,829,681 A 11/1998 Hamel et al.
5,836,517 A 11/1998 Burns et al.
6,929,151 B1 8/2005 Clayton
D532,862 S 11/2006 Chung
(Continued)

OTHER PUBLICATIONS

U.S. Appl. No. 29/544,129, Rasmussen.
(Continued)

*Primary Examiner* — Steven J Ganey
*Assistant Examiner* — Tuongminh N Pham
(74) *Attorney, Agent, or Firm* — Sheridan Ross P.C.

(57) ABSTRACT

A spray gun for dispensing fluids is provided. The spray gun provides a plurality of trigger members for activating a valve of the gun and enabling dispensation of a fluid. At least some of the trigger members can be provided in force transmitting communication with at least one additional trigger member, such that activation of any one or more of the trigger members is capable of enabling dispensation of a fluid.

13 Claims, 8 Drawing Sheets

(56) References Cited

U.S. PATENT DOCUMENTS

| | | | | |
|---|---|---|---|---|
| 7,266,893 | B1 * | 9/2007 | Ellson | A01D 34/84 172/14 |
| D617,416 | S | 6/2010 | Chen | |
| D636,846 | S | 4/2011 | Shoemaker | |
| D636,848 | S * | 4/2011 | Fontaine | B05B 7/02 D23/226 |
| 8,708,254 | B2 | 4/2014 | Baxter et al. | |
| D709,990 | S | 7/2014 | Loudon et al. | |
| 8,893,991 | B2 | 11/2014 | Alexander et al. | |
| 9,216,441 | B2 | 12/2015 | Pacht | |
| D756,485 | S | 5/2016 | Rasmussen | |
| 2007/0278442 | A1 * | 12/2007 | Wang | B05B 1/3013 251/231 |
| 2012/0223163 | A1 * | 9/2012 | Pacht | B08B 3/028 239/526 |

OTHER PUBLICATIONS

International Search Report and Written Opinion for International Patent Application No. PCT/US16/17818, dated May 19, 2016, 12 pages.

Official Action for Canadian Patent Application No. 167996, dated Jul. 11, 2016, 2 pages.

Notice of Grant with English translation for Chinese Patent Application No. 201630131791.1, dated Aug. 4, 2016, 4 pages.

Notice of Allowance for U.S. Appl. No. 29/517,538, dated Jan. 6, 2016, 8 pages.

Notice of Allowance for U.S. Appl. No. 29/517,538, dated Oct. 3, 2016, 8 pages.

* cited by examiner

HAND HELD FLUID DISPENSING APPARATUS

This U.S. Non-Provisional Patent Application claims the benefit of priority of U.S. Provisional Patent Application Ser. No. 62/115,857, filed Feb. 13, 2015 and U.S. Provisional Patent Application Ser. No. 62/204,687, filed Aug. 13, 2015, the entire disclosures of which are hereby incorporated by reference in their entireties.

FIELD

The present disclosure generally relates to spray guns for dispensing fluids. More specifically, embodiments of the present disclosure relate to spray guns for dispensing fluids placed under pressure by a pump, such as in pressure washers and similar devices and wherein the spray guns comprise a plurality of preferably interconnected trigger mechanisms for operation by a user.

BACKGROUND

Spray guns and devices for pressurized paints and fluids are generally known in the art. Such devices typically comprise at least one trigger or activation member to selectively dispense materials. However, known devices fail to provide various novel features as shown and described herein.

U.S. Pat. No. 5,236,129 to Grime et al., which is hereby incorporated by reference in its entirety, provides a hand held spray gun for a painting device. The device of Grime provides a plurality of triggers arranged to be operated by different fingers of a user and to facilitate operation when the gun is held in different orientations, preferably to reduce fatigue and operating frequency stress on an operator's fingers. Grime, however, fails to disclose a device with multiple trigger members that are interconnected to one another or otherwise capable of interacting.

U.S. Pat. No. 8,893,991 to Alexander et al., which is hereby incorporated by reference in its entirety, provides a hand-held dispensing device with a trigger device and a handle capable of selecting a number of different sources for dispensing operations. Alexander fails to disclose a dispensing device with a plurality of trigger members, let alone multiple trigger members which are in communication with each other.

U.S. Pat. No. 5,836,517 to Burns et al., which is hereby incorporated by reference in its entirety, provides a spray gun with a fluid control valve and first and second triggers. Burns, however, fails to disclose a gun with a plurality of triggers wherein such triggers are operatively interconnected.

SUMMARY

A long-felt and unmet need exists for a spray gun device that has a plurality of trigger members and wherein at least one trigger member is operatively interconnected to at least one additional trigger member. Embodiments of the present disclosure provide a spray gun with a plurality of means to operate the spray gun and dispense liquids therefrom. In preferred embodiments, a plurality of members for activating a nozzle, wand, or similar dispensing device, are interconnected, such that activation of one members simultaneously activates at least one additional members.

In certain embodiments, devices of the present disclosure comprise a dispensing device comprising first, second and third member for activating the dispensing device, and the members comprise a user-operated trigger. The trigger members are interoperable or interconnected to form a relationship therebetween wherein activation of any one of the trigger members transmits a force to release a fluid (e.g. through a nozzle or valve). Such a device provides a system wherein a plurality of triggers may be simultaneously activated such that a user may use two hands to activate two triggers and provide for easier operations of the device. Alternatively, such a device provides a system wherein a user may activate any one of a plurality of triggers based on user preference and/or a particular application or situation and wherein activation of any one of the trigger members provides the same fluid dispensation result as any other trigger mechanism.

Embodiments of the present disclosure provide for an ergonomic device that provides numerous benefits, including improved spraying accuracy, decreased fatigue upon a user, and distribution of force and stress across multiple device components such that a longer usable life of the device is enabled.

In one embodiment, first, second and third trigger members are operatively connected to a valve member wherein activation of any one the first, second and third trigger members activates a dispensing operation of a fluid through the valve member.

Various embodiments of the present disclosure comprise a gun type stock or body member and the gun type stock comprises a trigger provided at a butt or rear end of the stock. The trigger is provided to move forward (i.e. toward a dispensing end of the device). Such embodiments provide various advantages including ease of use, reduced fatigue, and greater ergonomic comfort of the gun, at least for some operators. Such embodiments allow for a user to pull or press the gun body or stock into the shoulder or torso of the user to activate the gun and to dispense liquids from the dispensing end thereof, allowing a user to use larger muscle groups (e.g. core, biceps) rather than relying solely on the smaller muscle groups of the hands which are known to become fatigued and/or numb during prolonged use of these types of devices.

In various embodiments, spray guns of the present disclosure comprise a plurality of triggers or trigger members. Such triggers preferably comprise elongate triggers such that at least a portion of a user's hand can grasp the trigger(s) to activate spraying operations. In various embodiments, the trigger(s) comprise a length of at least approximately two inches, and preferably of at least approximately four inches.

In certain embodiments, methods of operating a spray gun are provided, the methods comprising a step of pulling or drawing a spray gun toward a user and imparting a force on a forwardly-moving trigger to activate the gun. In such methods, additional and interconnected triggers may be used simultaneously with the forwardly-moving trigger, or only a single trigger may be used to activate a spray operation.

As used herein, the term "activation" as used at least with respect to the triggers of the present disclosure refers to a depression or other movement of the trigger by the application of force. It will be recognized that the triggers of the present disclosure are contemplated as comprising various different forms. Accordingly, the specific "activation" motion or method comprises various different movements and actions. In preferred embodiments, at least one trigger comprises a mechanical trigger that is pivotable or rotatable about a point or a hinge, and activation of such triggers refers to a compression, displacement or depression of at least a portion of the trigger. In alterative embodiments, however, it is contemplated that "activation" of the trigger(s) comprises a sliding or translating movement, for example. The terms "activating", "activation", and/or "activate" are therefore not intended to imply any specific movement or motion apart from that required for a trigger member to convey a force to additional components or features of the present disclosure.

In one embodiment, a spray gun for dispensing a fluid is provided. The spray gun comprises a fluid inlet, a fluid outlet, a valve provided in a fluid flow path between the fluid inlet and the fluid outlet, the valve being operable to selectively prevent a fluid from exiting the fluid outlet. A first trigger is interconnected to and operable to activate the valve, the first trigger comprising a first end and a second end. The first end is interconnected to the valve and the second end comprises a free end that is rotatable about a hinge. A second trigger is in force-transmitting communication with the first trigger, and the second trigger comprises a first end and a second end. The first end of the second trigger member comprises a hinge and the second end of the second trigger member comprises a free end operable to apply a force to the first trigger member. Activation of at least one of the first trigger and the second trigger activates the valve and dispenses a fluid from the fluid outlet.

The Summary is neither intended nor should it be construed as being representative of the full extent and scope of the present disclosure. The present disclosure is set forth in various levels of detail in the Summary as well as in the attached drawings and the Detailed Description and no limitation as to the scope of the present disclosure is intended by either the inclusion or non-inclusion of elements, components, etc. in this Summary. Additional aspects of the present disclosure will become more readily apparent from the Detailed Description, particularly when taken together with the drawings.

BRIEF DESCRIPTION OF THE DRAWINGS

The accompanying drawings, which are incorporated in and constitute a part of the specification, illustrate embodiments of the disclosure and together with the general description of the disclosure given above and the detailed description of the drawings given below, serve to explain the principles of the embodiments.

It should be understood that the drawings are not necessarily to scale. In certain instances, details that are not necessary for an understanding of the disclosure or that render other details difficult to perceive may have been omitted. It should be understood, of course, that the disclosure is not necessarily limited to the particular embodiments illustrated herein.

DETAILED DESCRIPTION

Figure 1:
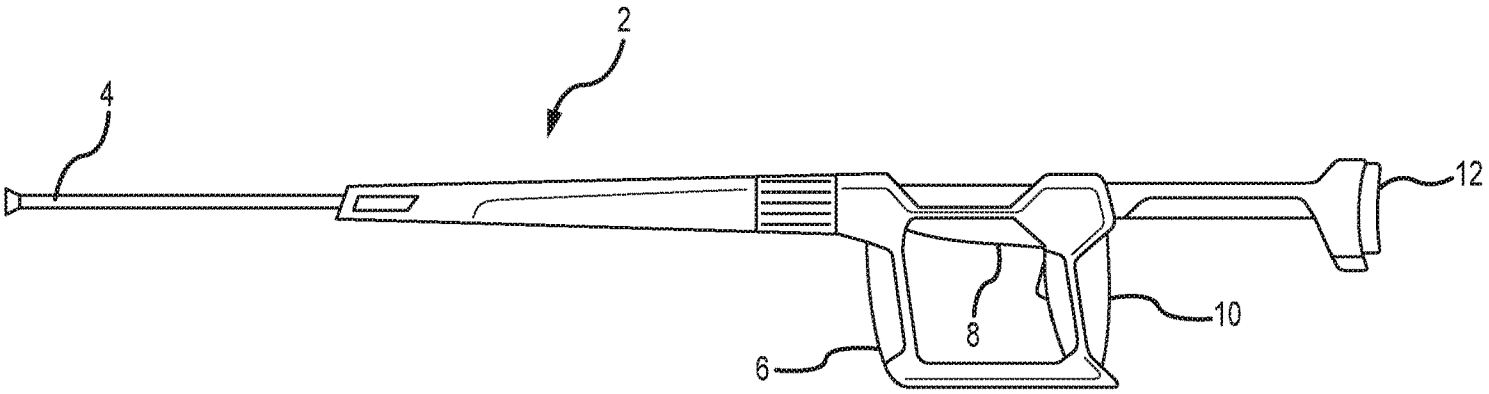
FIG. 1 is a side elevation view of a spray gun according to one embodiment of the present disclosure.

FIG. 1 is a side elevation view of a spray gun 2 according to one embodiment of the present disclosure. As shown, the gun 2 comprises an outlet or nozzle 4 extending from a handle member 6. The handle member 6 may comprise any one or more materials including, for example, a molded plastic or metal material. The gun 2 comprises first 8, second 10 and third 12 trigger members. In certain embodiments, at least one of the trigger members 8, 10, 12 is interconnected to at least one additional trigger member. In preferred embodiments, activation of any one of a plurality of trigger members causes a dispensation of fluid from a distal end or nozzle 4 of the device 2. The body of the device 2 may include various user-interface portions for gripping and manipulating the device 2. It will be recognized that the present disclosure is not limited to any particular style or arrangement of spray gun, and that various embodiments of the present disclosure as shown and described herein may be employed in various different devices. Additionally, although a specific arrangement of trigger members 8, 10, 12 is shown in FIG. 1, it will be recognized that the present disclosure is not limited to this particular arrangement.

Figure 2:
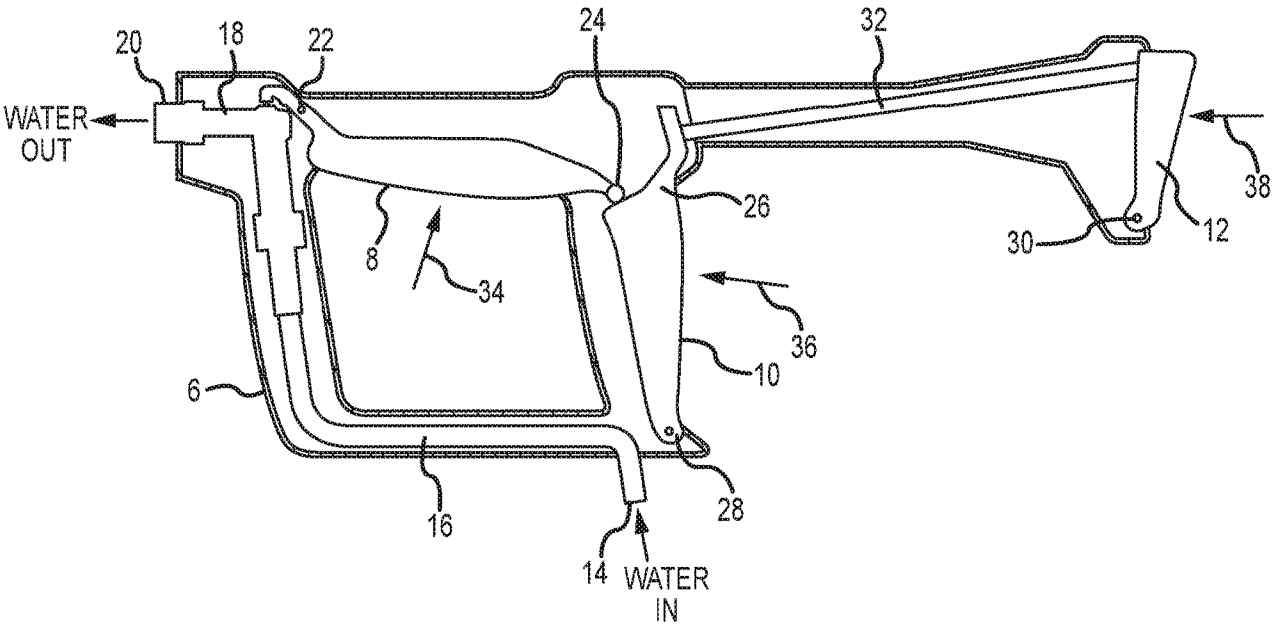
FIG. 2 is a cross-sectional elevation view of a spray gun according to one embodiment of the present disclosure.

FIG. 2 is a cross-sectional elevation view of a spray gun 2 and associated trigger mechanism according to one embodiment of the present disclosure. As shown in FIG. 2, a handle portion 6 is provided with at least one fluid inlet 14. The fluid inlet 14 is in fluid communication with a fluid outlet 20 via a fluid conduit 16. The device further comprises a user-operable valve 18 to regulate flow of fluid through the fluid outlet 20. The valve 18 is controlled by one or more trigger members 8, 10, 12 as shown and described herein. It will be recognized that the placement and orientation of the fluid inlet 14, fluid conduit 16, valve 18 and fluid outlet 20 is not critical to the present disclosure and various alternative arrangements are contemplated.

A trigger mechanism according to certain embodiments of the present disclosure and as shown in FIG. 2 comprises first 8, second 10 and third 12 trigger members. A first trigger member 8 extends at least partially from the handle portion 6 such that it is accessible to a user. The first trigger member 8 is operable to activate the valve 18. In the depicted embodiment, the first trigger member 8 comprises a pivot point 22 about which an upward movement of a portion of the trigger member due to application of a user-applied force 34 is converted to a downward movement or force upon the valve 18 to open the valve and enable fluid to pass through the fluid outlet 20. In the depicted embodiment, operation of only the first trigger member 8 enables fluid to be dispensed from the system.

As shown in FIG. 2, the first trigger member 8 is provided in communication with at least a second trigger member 10. The first trigger member 8 comprises a distal end 24 with a contact surface operable to contact a second trigger member 10. The distal end 24 of the first trigger member 8 may comprise a roller bearing or a smooth surface such that slidable movement of the second end 24 is not impeded. The second trigger member 10 comprises a pivot point 28 on a first end and a cammed, ramped, or inclined surface on a second end 26. As shown in FIG. 2, the second end 26 of the second trigger member 10 comprises multiple inclined angles to affect a movement of the first trigger member 8 when a user-applied force 36 is applied to the second trigger member 10. In the depicted embodiment, a force 36 applied to the second trigger member 10 will activate the second trigger member 10 and the first trigger member 8, causing actuation of the valve 18 and enabling fluid dispensation. In this arrangement, the first trigger 8 and/or the second trigger 10 may be operated to dispense fluids from the device 2.

In alternative embodiments, a second trigger member 10 comprises an elongated track at the second end 26 of the trigger 10. An end 24 of the first trigger member 8 is provided in the track and translatable therein. In such embodiments, activation of the first trigger 8 will cause second and third triggers 10, 12 to move based on the direct connection to the first trigger member 8.

In further embodiments, it is contemplated that the third trigger 12 is connected directly to the first trigger 8, such that activation of the third trigger 12 activates the first trigger 8 and the valve 18 without also activating the second trigger 10. In certain embodiments, the first trigger 8 comprises a forked second end 24 wherein each branch or tang of the forked member is provided in contact with the second 10 and third 12 trigger members, respectively. The third trigger 12 of the depicted embodiment comprises a rear-trigger member that is provided to move forward (i.e. toward the outlet of the gun). This trigger 12 provides a user with the ability to draw or pull the gun 2 toward the core or shoulder of the user and activate dispensation of fluid as shown and described herein. Such a method of activation or trigger depression provides various advantages, including the ability to operate the gun 2 with reduced reliance on the hands and fingers of a user and thereby provides for less fatigue and greater ergonomic comfort. Additionally, operation of the device 2 is further aided by the orientation and positioning of the third trigger member 12 wherein a blowback force of the gun provides additional force operable to depress the trigger when fluid is dispensed.

Embodiments of the present disclosure further comprise a third trigger member 12. In the embodiment provided in FIG. 2, a third trigger member 12 is provided at an end of the device 2. The third trigger member 12 is interconnected to the second trigger member 10 by a substantially rigid linkage member 32 such that a direct connection is provided between the third trigger member 12 and the second trigger member 10. The third trigger member 12 comprises a pivot point 30 about which at least a portion of the handle 12 is rotatable. A user-applied force 38 will thus actuate the third trigger member 12 and cause movement of the second trigger member 10 due to the connection 32 provided therebetween. Movement of the second trigger member 10 will cause movement of the first trigger member 8 as shown and described herein which will actuate the valve 18 and dispense fluids from the device 2. Accordingly, a system is provided wherein activation of any one or more of the plurality of trigger devices provided on the gun will actuate a valve and dispense fluids. Accordingly, a system is provided wherein a user may dispense fluids by activation of any one of a plurality of triggers as may be desired based on user preference or a particular application. Additionally, a user may selectively and simultaneously apply a force to a plurality of trigger members thereby distributing the force needed to actuate the valve 18 and providing for easier use.

Figure 3:
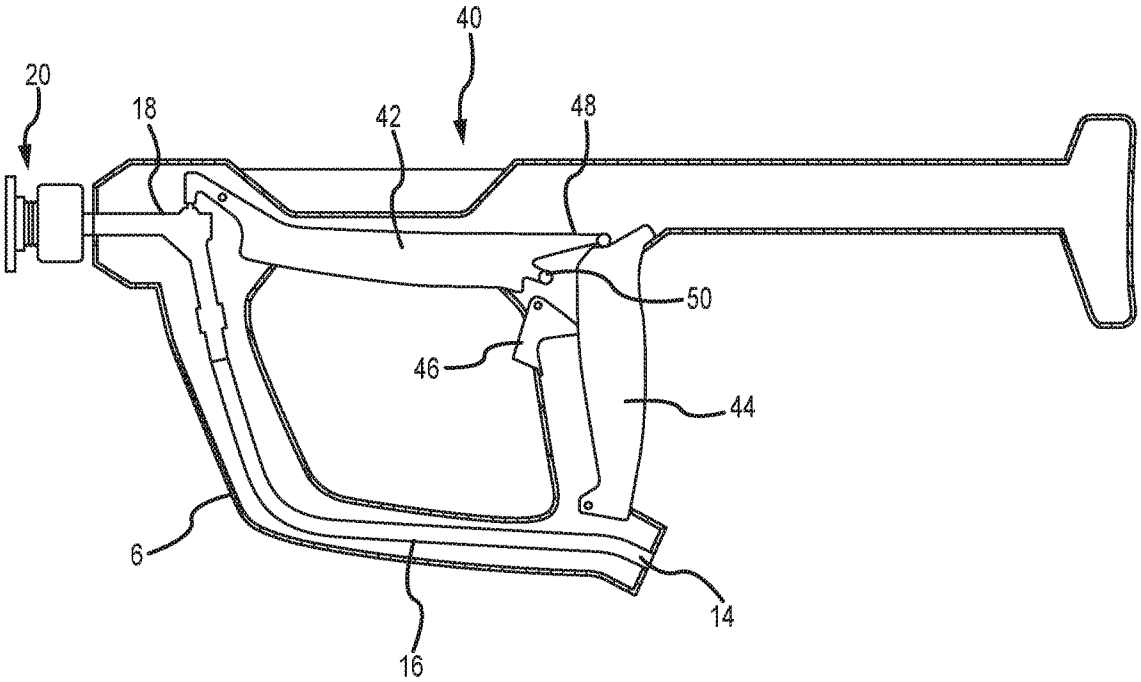
FIG. 3 is a cross-sectional elevation view of a spray gun according to one embodiment of the present disclosure.
Figure 4:
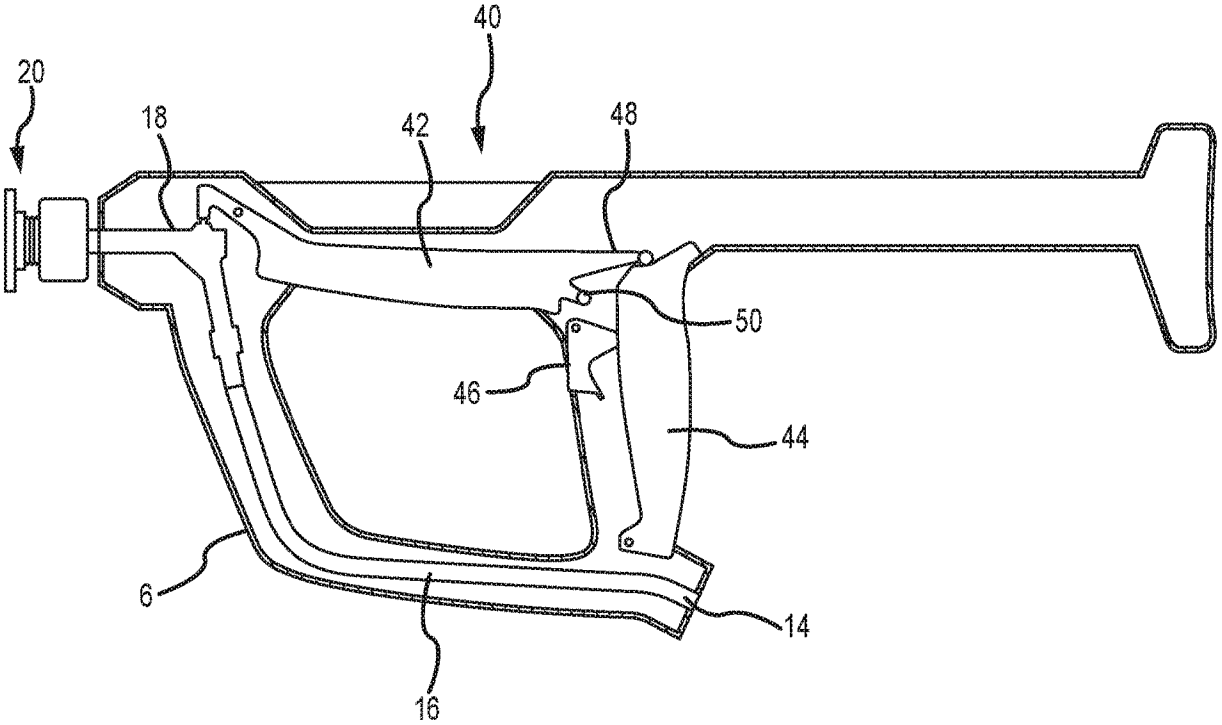
FIG. 4 is a cross-sectional elevation view of a spray gun according to the embodiment of FIG. 3.
Figure 5:
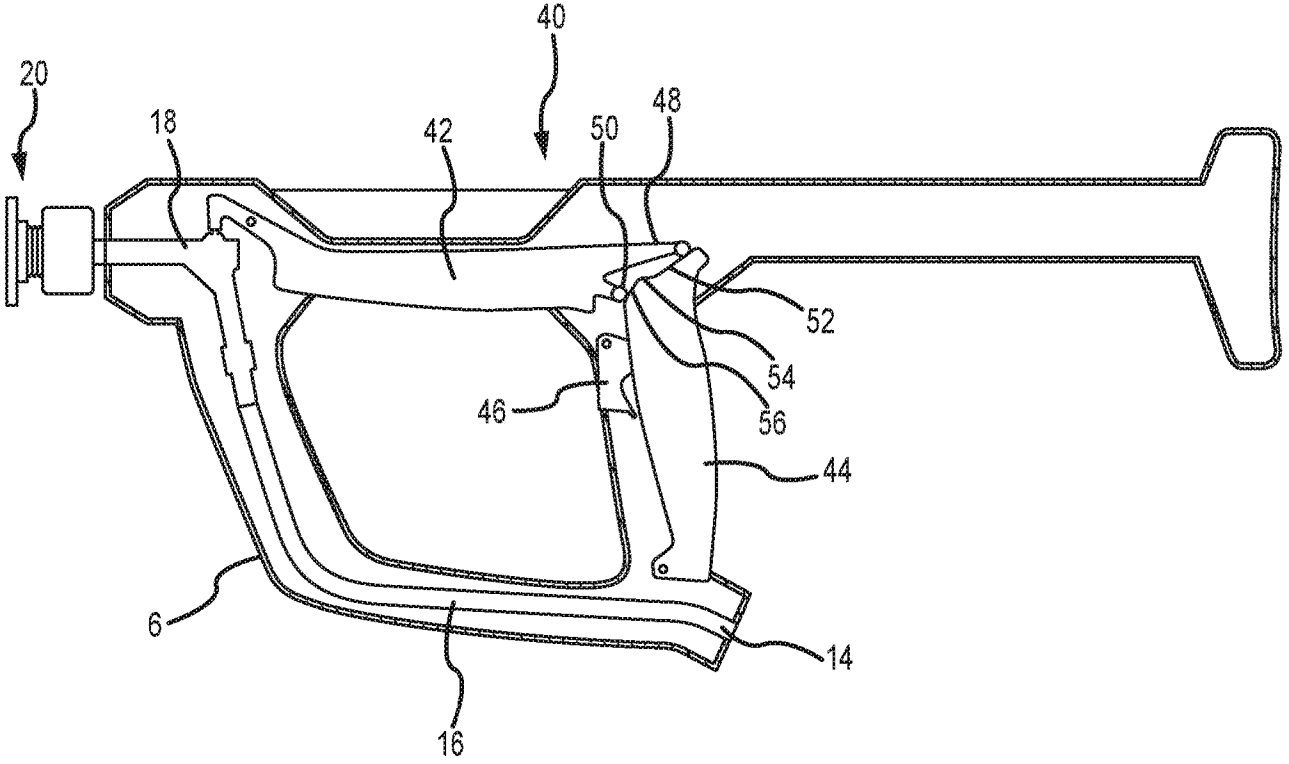
FIG. 5 is a cross-sectional elevation view of a spray gun according to the embodiment of FIG. 3.

FIGS. 3-6 are cross-sectional elevation views of a fluid dispensing device 40 according to another embodiment of the present disclosure. As shown, the device 40 comprises various features as shown and described with respect to the embodiments of FIGS. 1-2 including, for example, a handle member 6, a fluid inlet 14, a fluid conduit 16, a valve 18 and a fluid outlet 20. The embodiment of FIGS. 3-6 comprises a first trigger 42 and a second trigger 44. The device 40 further comprises a safety trigger 46. The safety trigger 46 comprises a lock-out feature that must be activated or moved prior to activation of either or both of the triggers 42, 44 to dispense fluid. In the depicted embodiment, the safety trigger 46 prevents inadvertent or accidental activation of the second trigger member 44, such as may occur by accidental collision or contact with the second trigger member 44. The safety trigger 46 comprises a hinged, pivotable member that obstructs movement of the second trigger member 44 unless the safety trigger 46 is depressed. The safety trigger 46 is provided on an interior portion of the handle member 6 such that grasping of the handle 6 and second trigger member by the hand of a user is required or adapted to release the safety trigger 46 and allow depression of the second trigger member 44. FIG. 3 depicts the safety trigger in a locked state, wherein movement of the second trigger 46 member is substantially prevented. FIG. 4 depicts the safety trigger 46 in an unlocked state, wherein the safety trigger 46 has been depressed, but the second trigger member 44 has yet to be depressed or activated. FIG. 5 depicts the safety trigger 46 in an unlocked state and wherein the second trigger member 44 has been depressed to activate fluid dispensing activities.

As further shown in FIGS. 3-5, the first trigger member 42 comprises a forked or bifurcated end portion having a first extension 48 and a second extension 50. The first 48 and second 50 extensions provide a means for activating the device using the second trigger member 44 and transferring force from the second trigger member 44 to the first trigger member 42. When both triggers are provided in an undepressed position (FIGS. 3-4), the first extension 48 is provided on an upper surface of the second trigger member 44 and the second extension 50 is preferably not in contact with the second trigger member 44. An upper surface of the second trigger member 44 preferably comprises a ramped or cammed upper surface. When the second trigger 44 is depressed, the first trigger member 42 is forced upwardly by contact with the first extension 48. As the second trigger 44 is moved inwardly, contact is made with the second extension 50 (FIG. 5). More specifically, as the second trigger 44 is moved inwardly, the first extension 48 travels along a first sloped surface 52 of the trigger 44, and the second extension 50 comes into contact with a third sloped surface 56 of the trigger 44. The third sloped surface 56 preferably comprises a different slope than that of the first sloped surface 52 and wherein the third sloped surface 56 comprises a greater slope than the first surface 52.

Figure 6:
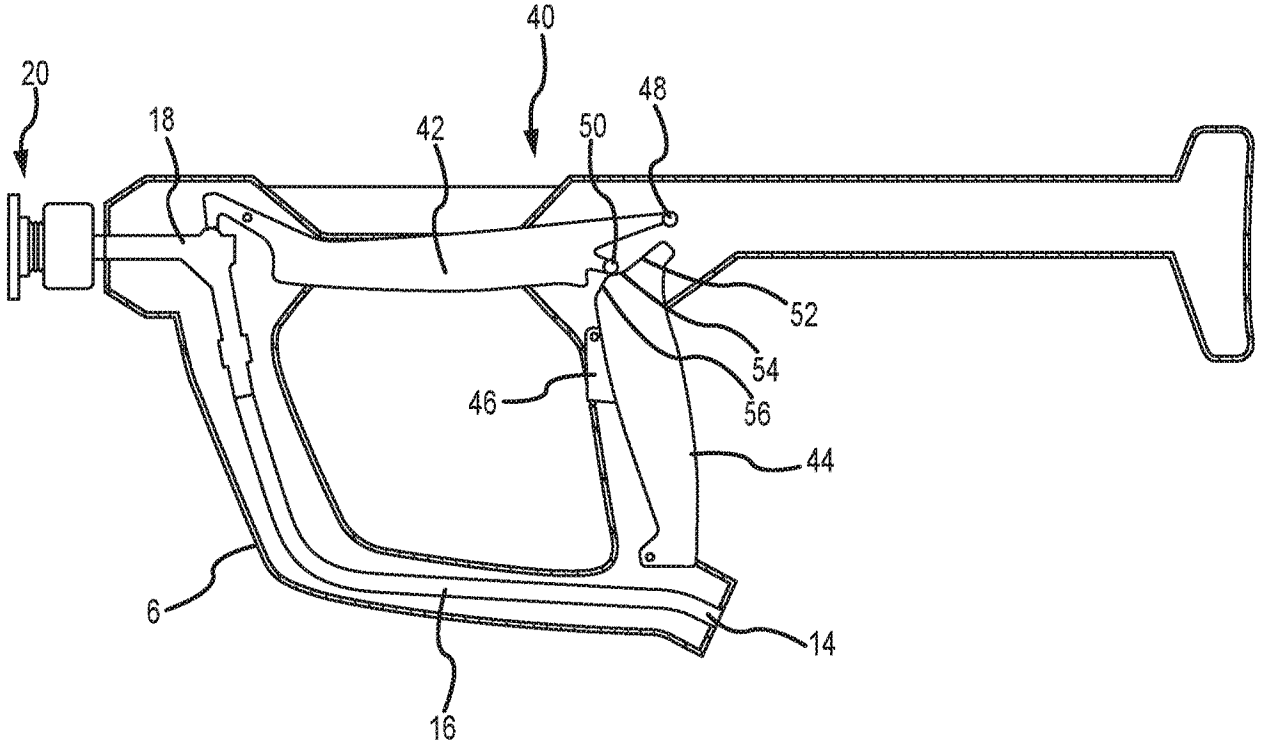
FIG. 6 is a cross-sectional elevation view of a spray gun according to the embodiment of FIG. 3.

Referring now to FIG. 6, a fully-depressed and activated position of the second trigger member 44 is shown. In the depicted embodiment, the second extension 50 has been translated to a position of contact with a second sloped surface 54. The second sloped surface 54 comprises a ledge or resting place for the second extension 50 and provides tactile feedback to a user that the trigger 44 is fully depressed. The first extension 48 has been removed from contact with the second trigger 44. In the position shown in FIG. 6, the first trigger member 42 is depressed by movement of and communication with the second trigger member 44. The first trigger member 42 thus activates the valve 18 to enable dispensing of fluid(s) from the outlet 20. In various embodiments, the second trigger member 44 is biased outwardly, such as by various springs or elastic members, to return the device to an "off" position when the triggers are released. In certain embodiments, the safety trigger 46 comprises a feature that may be used to selectively move the second trigger 44 outwardly and allow at least the second extension 50 to return to the third sloped surface 56 of the trigger 44 and complete the deactivation of dispensing activities.

Figure 7:
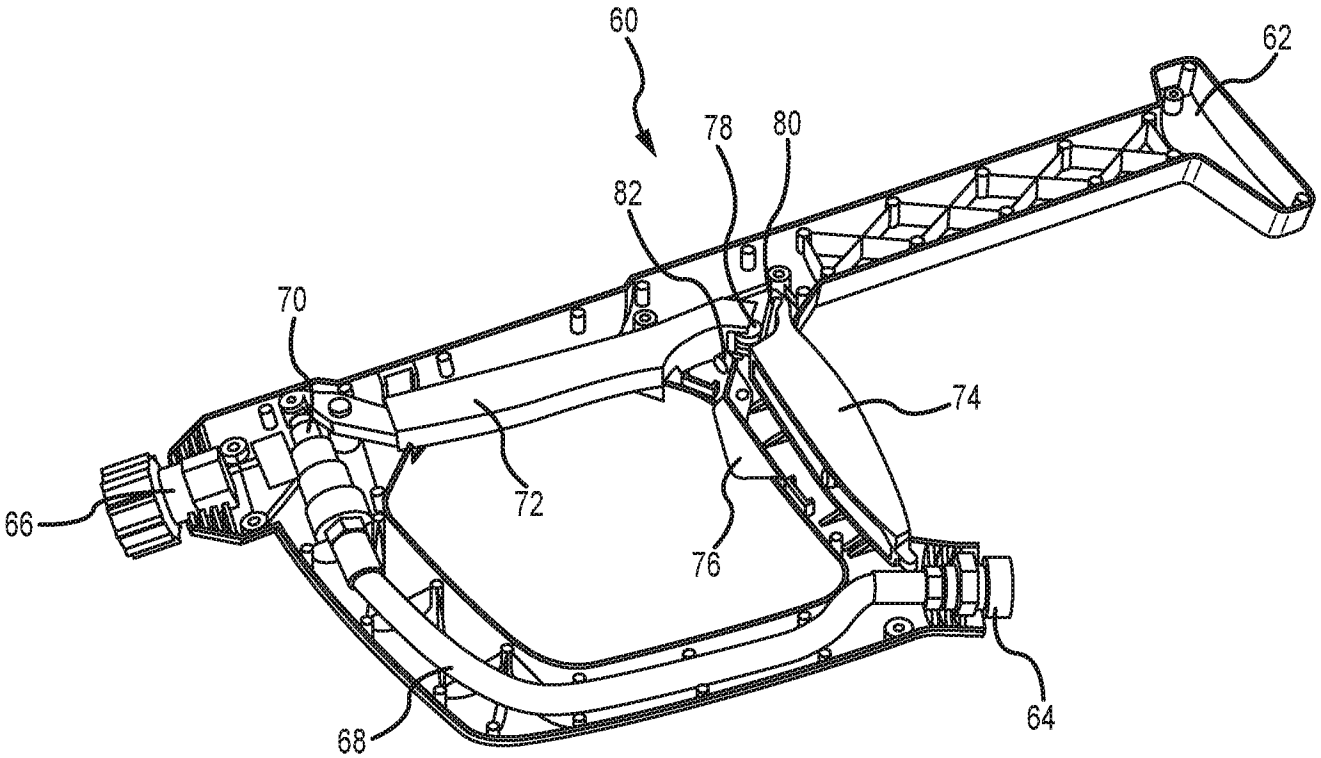
FIG. 7 is a cross-sectional perspective view of a spray gun according to one embodiment of the present disclosure.

FIG. 7 is a cross-sectional perspective view of another embodiment of the present disclosure. As shown, a fluid dispensing device 60 is provided comprising a handle 62, a fluid inlet 64, a fluid outlet 66, a conduit 68, a valve 70, a first trigger 72, a second trigger 74 and a safety release mechanism 76. As previously discussed, the first trigger member 72 comprises a hinged member in communication with a valve 70 at one end for selectively dispensing fluid(s) through the fluid outlet 66. The first trigger member 72 may be activated alone to dispense fluid(s), or the second trigger member 74 may be activated to impart a force on the valve 70 via the first trigger member 72. More specifically, a second end of the first trigger member 72 comprises a contact point 78 for interaction with a first end of the second trigger member 74. In the depicted embodiment, the contact point 78 comprises a roller member for ease of movement of the triggers. It will be recognized, however, that the present disclosure is not limited to embodiments comprising such a roller, and that various features and interfaces between the trigger members are contemplated.

As shown, the contact point 78 is provided in force transmitting communication with an angled surface 80 of the second trigger 74, such that movement of the second trigger 74 provides a corresponding movement of the first trigger 72. A safety release mechanism 76 is provided wherein at least a portion of the safety release mechanism 76 extends toward an interior portion of the handle 62, and a stop 82 is provided internal to the handle and opposite a hinge point from the user interface. The release mechanism preferably comprises a hinged and pivotable member such that depression of a user-interface portion of the safety 76 moves the stop 82 forward and into a position that does not obstruct movement or depression of the second trigger 74. The safety release mechanism 76 thus prevents or minimizes accidental depression of the second trigger 74 and generally requires a user to grasp the device 60 in a predetermined manner in order to activate fluid dispensing operations. In certain embodiments, the safety release mechanism 76 may be biased toward a position wherein movement of the second trigger is restricted, such as by a spring or similar component.

Figure 8:
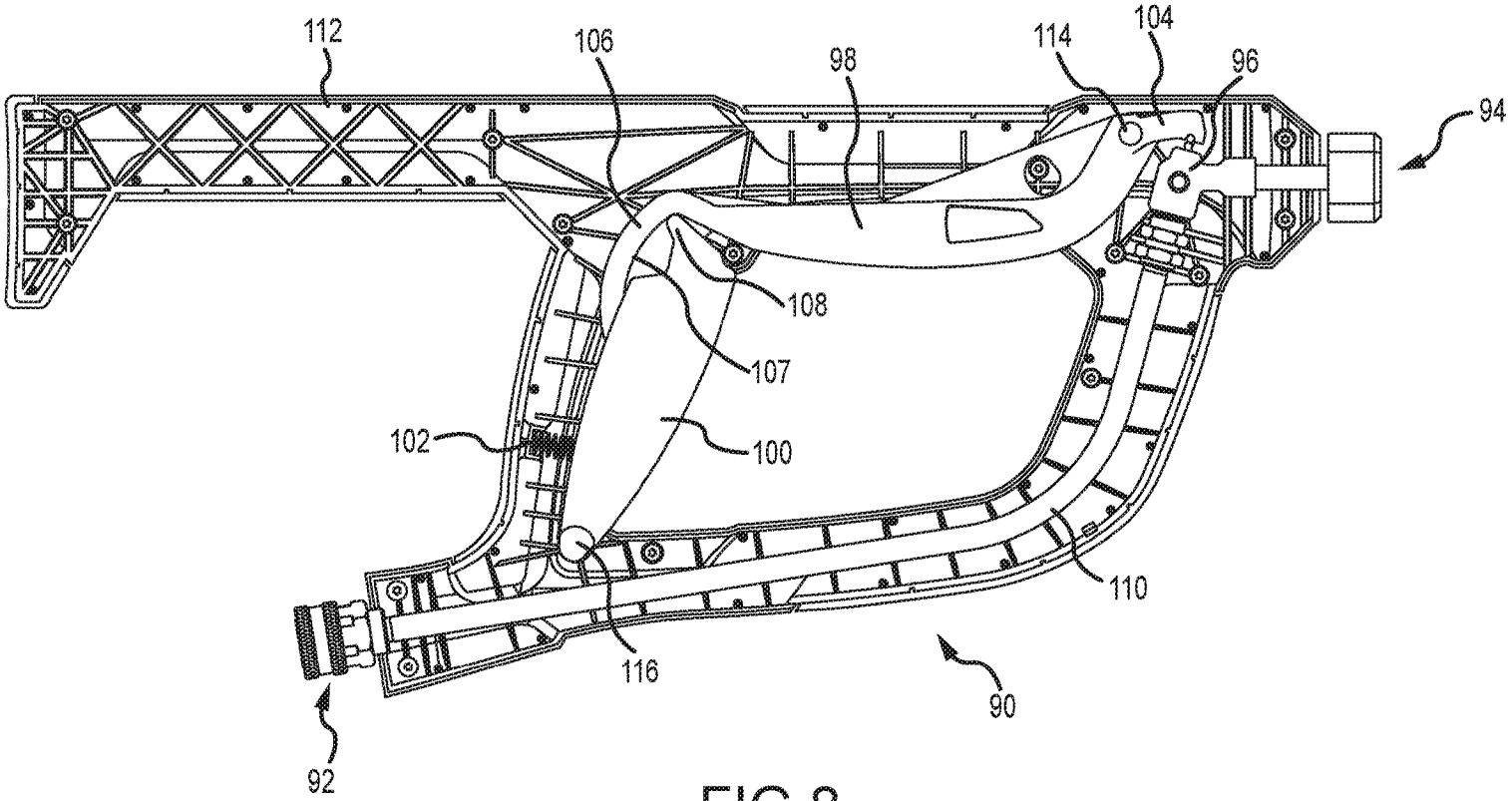
FIG. 8 is a cross-sectional elevation view of a spray gun according to one embodiment of the present disclosure.

FIG. 8 is a cross-sectional elevation view of a spray gun 90 according to one embodiment of the present disclosure. As shown, the spray gun 90 comprises a fluid inlet 92 and a fluid outlet 94. A valve 96 is positioned between the fluid inlet 92 and the fluid outlet 94, the valve 96 being provided to selectively activate and terminate a flow of fluid through the outlet 94. A fluid conduit 110 is provided to convey fluid between the fluid inlet 92 and the fluid outlet 94, and preferably between the fluid inlet 92 and the valve 96. The valve 96 is affected by depression or activation of one or more of a first trigger 98 and a second trigger 100. The first trigger 98 comprises an elongate trigger member wherein at least a portion of the first trigger 98 is adapted for contact and grasping by at least a portion of a human hand. The first trigger 98 comprises a first end 104 provided proximal to and preferably in force-transmitting contact with the valve 96 to operate the valve 96, and a second end 106 provided on an opposing end of the trigger 98. In the depicted embodiment of FIG. 8, the first trigger 98 comprises a hinge or pivot point 114 provided proximal to the first end 104 of the trigger member 98. When the trigger 98 is depressed or activated, such as by an application of force from a user's hand, the second end 106 rotates upwardly (in the orientation shown in FIG. 8), and the first end 104 moves downward due to rotation of the trigger member 98 about the pivot point 114. The movement of the first end 104 of the trigger 98 applies a force to the valve 96, and activates the valve 96 to allow for dispensation of fluid therefrom.

As also shown in FIG. 8, the second end 106 of the first trigger 98 comprises a curved or arcuate portion. An interior portion 107 of the arcuate portion comprises a contact surface for the second trigger 100. The interior portion 107 preferably comprises an arcuate surface having at least one radius of curvature for slidably receiving a distal end 108 of the second trigger 100 such that when the second trigger 100 is depressed, displaced or activated, the first trigger 98 is also displaced or activated, even if force is not applied directly to the first trigger 98. A first end of the second trigger 100 comprises a hinge or pivot point 116. The pivot point 116 preferably comprises a pin connection about which the second trigger 100 is allowed to pivot or rotate. The position of the first trigger 98 and the second trigger 100 as shown in FIG. 8 comprises a position of non-use wherein neither the first trigger 98 nor the second trigger 100 are depressed, and the valve 96 is provided in a closed or inactivated position to prevent egress of fluid through the valve 96 and outlet 94. In order to dispense fluid from the device, at least one of the first trigger 98 and the second trigger 100 may be depressed or activated. Depending upon user preference and/or various environmental or ergonomic conditions, a user may activate only the first trigger 98 by depressing the first trigger 98 and moving a second end 106 of the first trigger upwardly (in FIG. 8), which causes the first trigger 98 to rotate about the pivot point 114 and force the first end 104 downwardly upon the valve 96 and opens the valve 96.

Various types of valves are contemplated for use with spray guns and devices of the present disclosure. Such valves preferably include, but are not limited to manually-activated valves for selectively allowing the release of fluid(s). Manual valves such as trigger valves, diaphragm valves, globe valves, and other valves that may be easily activated by movement of the trigger members shown and described herein are preferably provided with embodiments of the present disclosure. In preferred embodiments, a trigger valve comprising a ball and valve seat is provided to control or limit fluid flow through an outlet of the gun. In such embodiments, a valve ball is held in a closed position by a valve spring, and the flow of water further forces the valve ball against the valve seat and blocks a flow of water unless and until a user applies a force to overcome the force of the valve spring and displace the valve ball. Specifically, when at least one trigger is depressed, the valve ball is moved away from the seat and a path is opened for water to flow through the outlet. When the trigger(s) is released, the spring returns the ball to the seat and blocks or terminates fluid flow.

In addition to or in lieu of activating the first trigger 98, a user may depress or activate the second trigger 100. Although the second trigger 100 is not in direct contact with the valve 96, movement of the second trigger 100 will cause the distal end 108 of the second trigger 100, which is preferably slidably engaged with the first trigger, to move in an arc about the pivot point 116 and apply a force to the interior surface 107 of the arcuate second end 106 of the first trigger. This movement will cause the first trigger 98 to move upwardly and activate the valve 96 as if the first trigger 98 was being activated directly by a user's force. As also shown in FIG. 8, the second trigger 100 is in communication with a biasing element or member 102 to bias or urge the second trigger 100 toward a closed position. The biasing member 102 of FIG. 8 comprises a coil spring to apply a force upon the second trigger 100 and urge the trigger 100 outwardly or away from a body of the device 90. It will be recognized, however, that various alternative biasing members maybe provided including, fore example, leaf springs, elastic members, etc. It will be recognized that in a preferred embodiment, a biasing element 102 is provided that comprises a coil spring. The biasing element may be linearly or non-linearly biased. Additionally, embodiments of the present disclosure are not limited to a coil spring biasing element, and various other devices as will be recognized by one of ordinary skill in the art are contemplated herewith.

In certain embodiments, the interior surface 107 of the second end 106 of the first trigger 98 comprises a flush contact surface for the distal end 108 of the second trigger 100 to contact. In alternative embodiments, the interior surface 107 comprises a track or recess in which at least a portion of the distal end 108 may be provided, the track or recess being operable to guide a movement of the second trigger 100 and prevent unwanted lateral displacement of the first trigger 100 which may cause misalignment of the triggers and impede proper operation of the device 90.

FIG. 8 depicts one embodiments of the present disclosure wherein the second end 106 of the first trigger 98 comprises an arcuate portion. In alternative embodiments, the second end 106 comprises a linear portion that is provided at an angle to a remainder of the first trigger 98. The linear portion is provided at an angle to create a ramped surface and allows the first trigger 98 to move in a desired manner when the second trigger 100 is activated or depressed.

In various embodiments, at least one of the hinges or pivot points of comprises a biasing member to return the handle(s) to an original position. For example, torsion springs may be provided in connection with pivot points to bias the triggers toward an un-depressed or non-activated position. In alternative embodiments, a pressure in the valve provides a restoring force to the trigger members such that the system is biased toward a closed position.

While preferred embodiments of the present disclosure comprise a spray gun for dispensing liquids from a pressure washing device, it will be expressly recognized that the present disclosure is not so limited. Indeed, it is contemplated that features of the present disclosure, including a dispensing mechanism with multiple modes of activation, may be provided in various devices and applications including but not limited to paint spray devices, While various embodiments of the present disclosure have been described in detail, it is apparent that modifications and alterations of those embodiments will occur to those skilled in the art. It is to be expressly understood that such modifications and alterations are within the scope and spirit of the present disclosure. Further, it is to be understood that the phraseology and terminology used herein is for the purposes of description and should not be regarded as limiting. The use of "including," "comprising," or "having" and variations thereof herein are meant to encompass the items listed thereafter and equivalents thereof, as well as, additional items.

What is claimed is:

1. A spray gun for dispensing a fluid, the spray gun comprising:

a fluid inlet;

a fluid outlet;

a valve provided in a fluid flow path between the fluid inlet and the fluid outlet, the valve being operable to selectively prevent a fluid from exiting the fluid outlet;

a first trigger interconnected to and operable to activate the valve, the first trigger comprising a first end and a second end and a length of at least approximately 2.0 inches extending therebetween, the first end interconnected to the valve and the second end comprising a free end that is rotatable about a hinge provided proximal to the valve;

a second trigger in force-transmitting communication with the first trigger, the second trigger comprising a first end having a hinge and a second end, and a length of at least approximately 2.0 inches extending therebetween, the second end of the second trigger comprising a free end and wherein the second trigger is operable to apply a force to the first trigger;

a molded body member, wherein the first and second triggers are hingedly connected to the molded body member;

the molded body member comprising a stock extending rearwardly beyond the first trigger, the second trigger, the fluid outlet and the fluid inlet, the stock being operable to allow a user to pull or press the molded body member into a user's body;

wherein the first trigger and the second trigger are configured to be grasped by a user, and wherein the first trigger and the second trigger are operable to control the valve;

wherein activation of at least one of the first trigger and the second trigger activates the valve and dispenses a fluid from the fluid outlet;

wherein the second end of the first trigger comprises a free end with an elongate concave surface and wherein the free end of the second trigger comprises first and second contact points that contact the concave surface of the first trigger in at least a first position, and wherein at least one of the first and second contact points is operable to contact the elongate concave surface to cause a movement of the first trigger when the second trigger is displaced;

a biasing member in direct contact with the second trigger to bias the second trigger in a first direction; and wherein the first trigger and the second trigger each comprise a surface operable for contact with a user such that operation of either or both of the first trigger and the second trigger is operable to control the valve and dispense fluid from the fluid outlet.

2. The spray gun of claim 1, wherein the second trigger comprises at least of a ramped, cammed, and arcuate surface in contact with the elongate concave surface of the first trigger.

3. The spray gun of claim 1, wherein the second end of the first trigger comprises a track or recess in which the second end of the second trigger is provided to prevent unwanted lateral displacement of the first and second triggers.

4. A spray gun for dispensing a fluid, the spray gun comprising:

a molded body member comprising a stock;

a fluid inlet;

a fluid outlet;

a valve provided in a fluid flow path between the fluid inlet and the fluid outlet, the valve being operable to selectively prevent a fluid from exiting the fluid outlet;

a first elongate trigger member interconnected to and operable to open the valve, the first elongate trigger comprising a first end and a second end, the first end operable to open the valve and the second end comprising a free end that is rotatable, and wherein the second end of the first elongate trigger comprises a concave contact surface, a second elongate trigger member in force-transmitting communication with the concave contact surface of the first trigger member, the second elongate trigger member comprising a first end and a second end, the first end of the second elongate trigger member comprising a hinge and the second end of the second trigger member comprising two points of contact, and wherein at least one of the two points of contact is operable to apply a force to the concave contact surface of the first elongate trigger member to displace the first elongate trigger member and actuate the valve, and wherein the second end of the second elongate trigger member is slidably received by the first elongate trigger member;

wherein the first elongate trigger member and the second elongate trigger member are configured to be grasped by a user, and wherein the first elongate trigger member and the second elongate trigger member are operable to control the valve;

wherein a depression of the first elongate trigger member opens the valve and dispenses a fluid from the fluid outlet;

wherein a depression of the second elongate trigger member applies a force to the first elongate trigger member and opens the valve and dispenses a fluid from the fluid outlet;

wherein the first elongate trigger member and the second elongate trigger member are provided at least partially within the molded body member;

wherein the stock extends rearwardly beyond the first trigger and in a direction parallel to the fluid outlet; and wherein the stock is operable to allow a user to pull or press the gun into a user's body.

5. The spray gun of claim 4, wherein the second elongate trigger member comprises at least of a ramped, cammed, and arcuate surface in contact with the concave contact surface of the first elongate trigger member.

6. The spray gun of claim 4, further comprising a biasing element in communication with the second elongate trigger member to bias the second elongate trigger member in a first direction.

7. A spray gun for dispensing a fluid, the spray gun comprising:

a body member comprising a stock;

a fluid inlet;

a fluid outlet;

a valve provided in a fluid flow path between the fluid inlet and the fluid outlet;

a first trigger interconnected to and operable to open the valve, the first trigger comprising a first end and a second end, the first end operable to open the valve and the second end comprising a free end having a curvilinear contact surface operable to receive a force;

a second trigger in force-transmitting communication with the curvilinear contact surface of the first trigger, the second trigger comprising a first end and a second end, the first end of the second trigger comprising a hinge and the second end of the second trigger end slidably engaged with the curvilinear contact surface of the first trigger, and wherein the second trigger is operable to selectively displace the first trigger;

wherein the first trigger and the second trigger are each at least partially disposed within the body member;

wherein each of the first trigger and the second trigger comprise a length and are operable to be grasped by a human hand, wherein a displacement of the first trigger opens the valve and dispenses a fluid from the fluid outlet;

wherein the stock comprises a butt and is operable to allow a user to pull or press the gun into a user's body; and wherein the second end of the second trigger and the curvilinear contact surface of the first trigger are provided at least partially within the body, and wherein the second end of the second trigger comprises a track for slidably receiving the second end of the first trigger.

8. The spray gun of claim 7, wherein the first trigger and second trigger are hingedly connected to the body.

9. The spray gun of claim 7, wherein the curvilinear contact surface comprises a concave surface.

10. The spray gun of claim 7, wherein the second trigger comprises at least of a ramped, cammed, and arcuate surface in contact with the curvilinear contact surface.

11. The spray gun of claim 7, further comprising a biasing element in communication with the second trigger to bias the second trigger in a first direction.

12. The spray gun of claim 7, wherein the first trigger comprises a hinge point proximal to the valve.

13. The spray gun of claim 7, wherein the first trigger and the second trigger each comprise a length of at least approximately two inches, and wherein the first trigger and the second trigger are adapted for use with a human hand.

* * * * *